United States Patent [19]

Hard Af Segerstad

[11] 4,202,074

[45] May 13, 1980

[54] CURTAIN SUSPENSION DEVICES

[76] Inventor: Göran J. F. Härd Af Segerstad, Borgmästarvagen 4, S-19030 Sigtuna, Sweden

[21] Appl. No.: 948,418

[22] Filed: Oct. 4, 1978

[30] Foreign Application Priority Data

Oct. 7, 1977 [SE] Sweden ..... 7711310

[51] Int. Cl.[2] ..... A47H 1/04

[52] U.S. Cl. ..... 16/94 D; 16/96 D; 16/DIG. 34; 16/DIG. 39; 24/73 CH; 211/105.1; 248/265; 403/4; 403/98; 312/246

[58] Field of Search ..... 16/94 D, 94 R, 95 R, 16/95 D, 96 R, 96 D, 87.4 R, 129, 130, 131, 132, DIG. 34, DIG. 39; 211/105.1, 123; 248/263, 265, 278; 403/98, 4; 160/123, 330; 24/261, 73 CH; 312/245, 246, 266

[56] References Cited

U.S. PATENT DOCUMENTS

| | | | |
|---|---|---|---|
| 1,935,246 | 11/1933 | Kirsch | 403/98 X |
| 2,161,956 | 6/1939 | Robertson | 403/98 |
| 2,201,787 | 5/1940 | Peckham | 248/265 |
| 2,719,739 | 10/1955 | Copeland | 403/98 |
| 3,183,546 | 5/1965 | Heller et al. | 16/94 D |
| 3,189,912 | 6/1965 | Miller | 16/129 X |
| 3,380,111 | 4/1968 | Segerstad | 16/94 D |
| 3,906,670 | 9/1975 | Burton | 16/129 X |

FOREIGN PATENT DOCUMENTS

| | | | |
|---|---|---|---|
| 1005926 | 9/1965 | United Kingdom | 403/98 |

*Primary Examiner*—Husar C. J.
*Assistant Examiner*—Moshe I. Cohen
*Attorney, Agent, or Firm*—Holman & Stern

[57] ABSTRACT

A curtain suspension device comprising a curtain board having a horizontal hole at each end for fastening upon a pair of stem brackets, each of which comprising a wall plate having peripheral holes for fastening to a wall by means of screws, and a central threaded hole receiving a correspondingly threaded stem extending at right angles to the wall surface to receive the curtain board at its outer end, and a spring clip adapted to clamp one upper corner of a curtain against the wall. The wall plate of said stem bracket is provided, diametrically opposite to a peripheral hole therein, with a slot in the form of an arc of a circle the center of which coincides with the center of said hole, and the wall plates of said two stem brackets are mounted or adapted to be mounted in a manner such that the symmetry axis through the peripheral hole, the center hole and the slot of said two wall plates intersect at an angle of 90°, wherein the symmetry axis of one of said two wall plates perferably is oriented in a vertical direction and the symmetry axis of the other wall plate is oriented in a horizontal direction.

2 Claims, 3 Drawing Figures

CURTAIN SUSPENSION DEVICES

BACKGROUND OF THE INVENTION

The present invention relates to an adjustable curtain suspension device comprising a curtain board having a horizontal hole at each end adapted to be engaged by stem brackets, each of which comprises a wall plate having peripheral holes for fastening to a wall by means of screws, and a central threaded hole, a bracket stem threadably engagable with the central threaded hole, said bracket stem extending in engaged position at right angles to the wall surface so as to support at its outer end said curtain board, and a spring clip adapted to clamp one corner of a curtain against the wall.

In my U.S. Pat. No. 3,380,111 there is described an arrangement for slidably supporting curtains, draperies and the like, said arrangement including a wooden longitudinal curtain board having substantially rectangular cross section and being provided with two grooves with a substantially T-shaped cross section which are adapted to receive freely movable slider elements and are substantially rotation-symmetrically arranged in the two opposite principal surfaces of the rectangular curtain board. The curtain board is provided with two through holes located near a respective one of the two opposite ends and is adapted to be placed on a pair of carrying brackets, each comprising a plate with holes for screws to be screwed into a wall, and a stem which projects from said plate and has substantially the same cross section as the through holes of the curtain board and upon which the curtain board may be placed with its through holes in frictional engagement with the bracket stems.

However, the stem bracket used in the arrangement according to U.S. Pat. No. 3,380,111 suffers from the disadvantage that a proper fitting of the curtain board's holes on the stems of the brackets after fastening to a wall presupposes that the holes in the wall for the bracket screws are drilled in the exact positions with respect to center distance between the through holes at each end of the curtain board, and in a manner such that the curtain board will be oriented in a horizontal plane. Accordingly, since it frequently happens that the rotating drill gets displaced from the marking point in the course of drilling, especially in a tiled wall, it is many times not possible with stem brackets of the type described to fasten the two brackets to receive a curtain board into the correct horizontal position and with the predermined exact distance between the two bracket stems.

Therefore, in view of these problems associated with the prior stem bracket, it is an object of the present invention to provide a curtain suspension device which affords a good possibility of post-adjusting the center distance between board-carrying bracket stems and their relative positions.

It is also an object of the invention to provide a curtain suspension device enabling individual height adjustment and stretching of the borders of outer as well as inner curtains.

SUMMARY OF THE INVENTION

In accordance with the present invention there is provided a curtain suspension device of the type comprising a curtain board having a horizontal hole at each end adapted to be engaged by one of a pair of stem brackets, each of which comprising a wall plate having peripheral holes for fastening to a wall by means of screws, and a central threaded hole, a bracket stem threadably engagable with the central threaded hole, said bracket stem extending in engaged position at right angles to the wall surface so as to support at its outer end said curtain board, and a spring clip to secure one upper corner of a curtain.

According to the invention, the wall plate of each stem bracket, diametrically opposite to a peripheral hole therein, is provided with a slot in the form of an arc of a circle the center of which coincides with the center of said hole, and the wall plates of said two stem brackets are mounted or adapted to be mounted in a manner such that the symmetry axes through the peripheral threaded hole, the center hole and the slot of said two wall plates intersect at an angle of 90°. Preferably, the symmetry axis of one of said two wall plates is oriented or adapted to be oriented in a vertical direction in order to enable an easy height adjustment of the wall plate into horizontal alignment with the other wall plate, the symmetry axis of which, in turn, consequently is oriented in a vertical direction so as to enable an easy adjustment of the distance between the wall plates to the predetermined fixed center distance between the through holes at each end of the curtain board.

BRIEF DESCRIPTION OF THE DRAWINGS

The present invention is illustrated in the accompanying drawings wherein.

DETAILED DESCRIPTION OF THE PREFERRED EMBODIMENT

Figure 1:
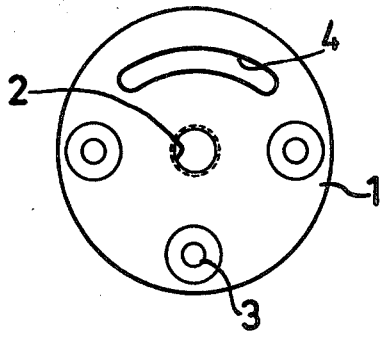
FIG. 1 is a view of the wall plate of a stem bracket used in the device according to the invention.

In FIG. 1 a wall plate 1 of a stem bracket used in the adjustable curtain suspension arrangement according to the present invention is shown. The wall plate 1 is provided with a central threaded hole 2 to receive the threaded inner end of a bracket stem 5 (FIG. 2), a hole 3 for a first screw adapted to fasten the plate to the wall, and an arcuate slot 4 for a second fastening screw. It should be noted that the center point of slot 4 coincides with that of the hole 3.

Figure 2:
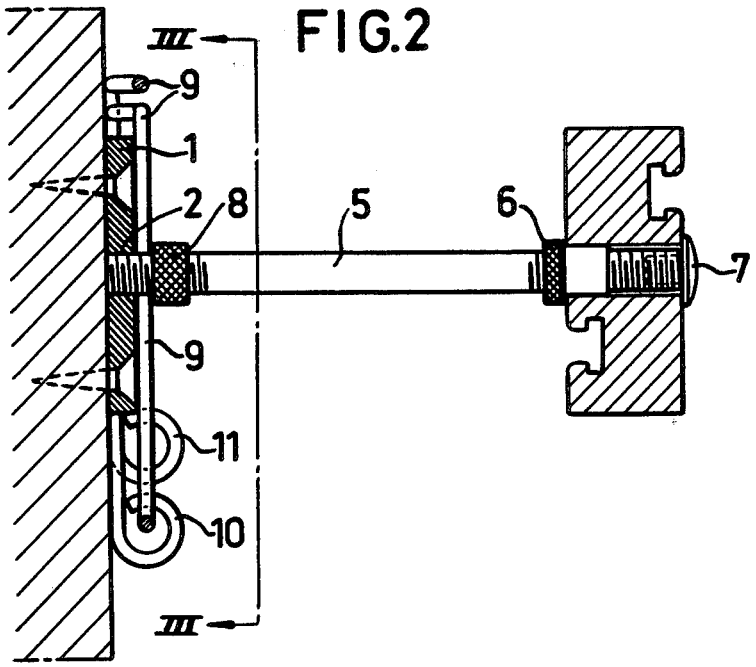
FIG. 2 is a sectional side view illustrating the stem bracket fastened to a wall by means of screws and carrying one end of a curtain board on its stem.

In FIG. 2 the same fastening plate 1 is shown with the bracket stem 5 secured in the central threaded hole 2 of the plate. The outer end of the bracket stem 5 is threaded and carries a nut 6 and a counter screw 7 to fasten the curtain rod, whereas the inward threaded end of the bracket stem facing the wall carries a nut 8 to stabilize and clamp a spring clip 9 against the plate 1.

Figure 3:
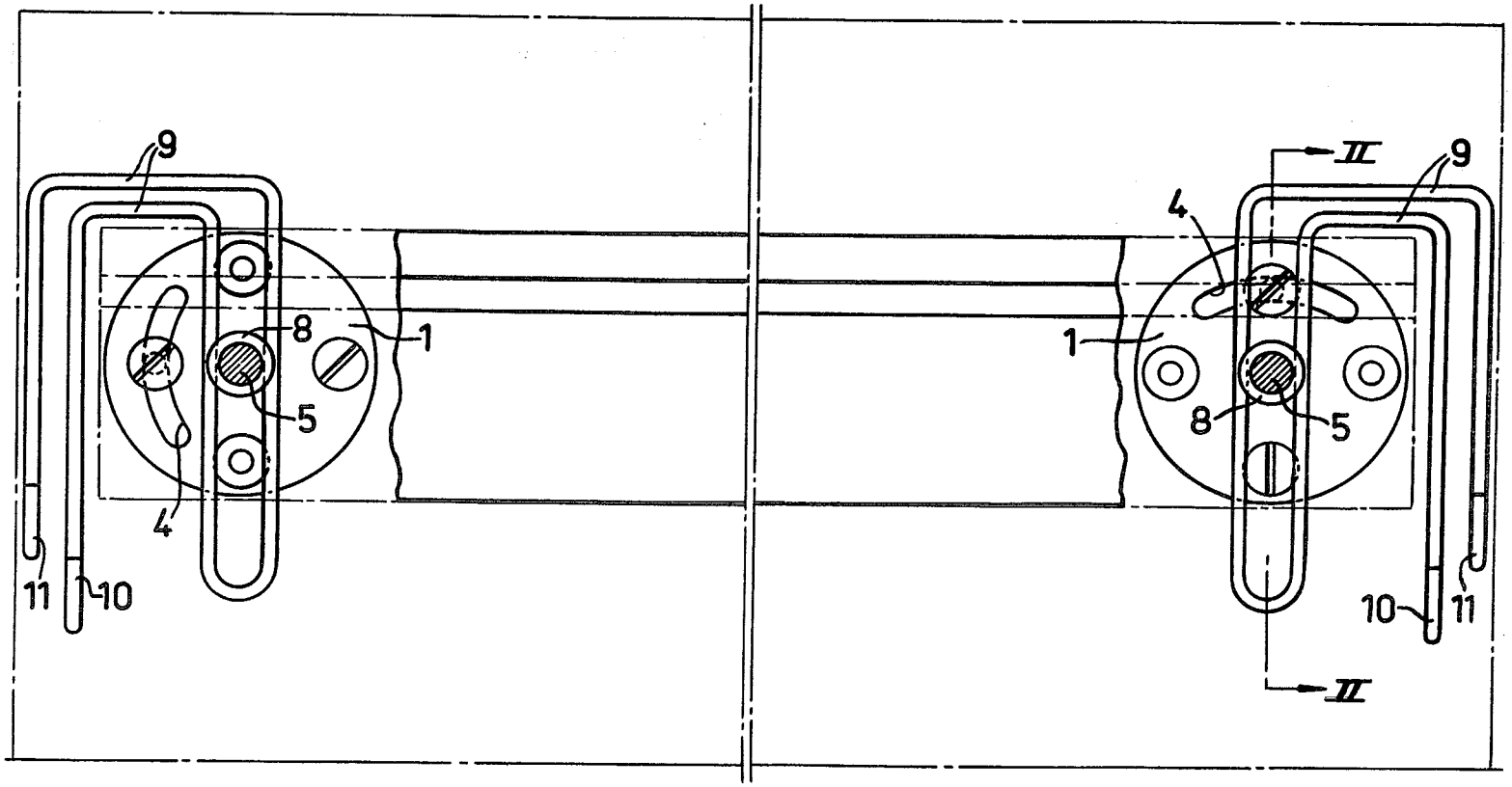
FIG. 3 is an elevation view of the adjustable curtain suspension device according to the present invention.

FIG. 3 shows the spring clip 9 clamped against the plate 1 with the nut 8 subsequent to a suitable height adjustment. The spring clip 9 has two free ends 10 and 11 adapted to resiliently abut the wall and thereby render it possible from below to place the borders of two curtains suspended in two slots of the curtain rod and individually to stretch and adjust their height position.

Preferably, the spring clip 9 consists of a U-bent spring wire with parallel legs, each leg of which in turn being bent in the form of two substantially parallel and coplanar U-shaped members, the width between the portions of said legs adjoining the arcuate intermediate portion being substantially the same as the diameter of the bracket stem 5, and the free ends of said legs being adapted resiliently to abut the wall surface to fasten a curtain.

It should be observed that the two fastening plates are rotated 90° with respect to each other. In this way it will be possible by individual turning of each plate to accomplish a stepless variation of the mutual position of the two bracket pins.

Although the invention is described in detail in respect to the example and the individual drawings, it will be clear that modifications in materials and structure can be made by those skilled in the art within the scope of the invention as defined in the appended claims.

What I claim is:

1. A curtain suspension device comprising a curtain board and a pair of stem brackets, said curtain board having a horizontal hole at each end for engagement by one of said pair of stem brackets, each of said brackets comprising a wall plate having peripheral holes for fastening to a wall by means of screws, a central threaded hole, a bracket stem threadably engagable with the central threaded hole, said bracket stem extending in engaged position at right angles to the wall surface so as to support at its outer end said curtain board, and a spring clip for securing one upper corner of a curtain, said spring clip engaging said stem for sliding movement in a vertical direction wherein the wall plate of each stem bracket, diametrically opposite to one of said peripheral holes includes a slot in the form of an arc of a circle the center of which is coplanar with the center of said one of said peripheral holes whereby the wall plates of said two stem brackets can be mounted in a manner such that the symmetry axes of the respective wall plates through the peripheral hole, the center hole and the slot intersect at an angle of 90°.

2. A curtain suspension device comprising in combination:

(a) a curtain board and a pair of stem brackets, said curtain board having horizontal holes at each end for engagement by one of said stem brackets, each of said stem brackets comprising a wall plate having peripheral holes for fastening to a wall by means of screws, a central threaded hole, and a bracket stem threadably engagable with said central hole, said bracket stem extending in engaged position at right angles to the wall surface so as to support at its outer end said curtain board, said wall plate of each stem bracket including, diametrically opposite to one of said peripheral holes, a slot in the form of an arc of a circle said slot having a center coplanar with the center of said one of said peripheral holes whereby the wall plates of said two stem brackets can be mounted in a manner such that the symmetry axis of one of said two wall plates through the peripheral hole, the central threaded hole and the slot is oriented in a vertical direction and the corresponding symmetry axis of the other of said two wall plates is oriented in a horizontal direction; and (b) a pair of spring clips each engaging the stem of one of said pair of stem brackets for securing one upper corner of a curtain, each said spring clip consisting of a U-bent spring wire with parallel legs, each leg of which in turn being bent in the form of two substantially parallel and coplanar U-shaped members, the width between the portions of said legs adjoining the arcuate intermediate portion being substantially the same as the diameter of the bracket stem, and the free ends of said legs being adapted resiliently to abut the wall surface to fasten said curtain corner.

* * * * *